US006073309A

United States Patent [19]

Klüting et al.

[11] Patent Number: 6,073,309

[45] **Date of Patent: *Jun. 13, 2000**

[54] DOOR LOCK FORMED INTEGRALLY WITH A SEPARABLE DOOR HINGE FOR A MOTOR VEHICLE DOOR

[75] Inventors: Bernd-Alfred Klüting, Radevormwald; Alexander Zernickel, Herzogenaurach; Detlef Görgens, Wermelskirchen; Rolf Fleischhauer, Fürth, all of Germany

[73] Assignee: ED. Scharwächter GmbH, Remscheid, Germany

[ * ] Notice: This patent is subject to a terminal disclaimer.

[21] Appl. No.: 09/133,091

[22] Filed: Aug. 12, 1998

[30] Foreign Application Priority Data

Aug. 12, 1997 [DE] Germany ..... 197 34 842

[51] Int. Cl.[7] ..... E05D 11/10

[52] U.S. Cl. ..... 16/334; 16/330; 16/322

[58] Field of Search ..... 16/334, 330, 328, 16/329, 331, 332, 352, 353, 312–314, 299, 300, 321, 322

[56] References Cited

U.S. PATENT DOCUMENTS

| | | | |
|---|---|---|---|
| 4,829,633 | 5/1989 | Kassner | 16/322 |
| 5,173,993 | 12/1992 | Baker | 16/329 |
| 5,878,463 | 3/1999 | Kluting et al. | 16/334 |

*Primary Examiner*—Chuck Y. Mah
*Attorney, Agent, or Firm*—Brown & Wood, LLP

[57] ABSTRACT

A door lock which is formed integrally with a motor vehicle door hinge and which includes a housing fixedly secured to the hinge pin or the one of the first and second hinge halves, a holding element having at least a partially curved running track concentric with a hinge pin axis and a plurality of detent points, a plurality of braking and locking members cooperating with the holding element for retaining a motor vehicle door in a predetermined braking and locking position, and formed as rolling bodies rotatable about respective support axles having their axes extending transverse to hinge pin axis, a carrier for supporting the braking and locking members, a spring for biasing the braking and locking members into engagement with the holding element, and an arrangement securing the holding element or the carrier to the housing without a possibility of rotation relative thereto and for axial displacement relative thereto.

18 Claims, 2 Drawing Sheets

DOOR LOCK FORMED INTEGRALLY WITH A SEPARABLE DOOR HINGE FOR A MOTOR VEHICLE DOOR

BACKGROUND OF THE INVENTION

1. Field of the Invention

The present invention relates to a door lock formed integrally with a motor vehicle door hinge having a first hinge half connectable with one part of a door assembly, a door or a door pillar, a second hinge half connectable with another part of the door assembly, and a hinge pin for connecting the first and second hinge halves for a rotational movement relative to each other and supported in one of the first and second hinge halves with a running fit and fixedly secured in another of the first and second hinge halves for joint rotation with the another of the first and second hinge halves, with the door lock including a housing fixedly securable to the hinge pin or the hinge half, in which the hinge pin is received with a running fit, without a possibility of rotation relative to the hinge pin or the hinge half, respectively, a holding element having at least a partially curved running track concentric with the hinge pin axis and having a plurality of detent points, a plurality of braking and locking members formed as rolling bodies and rotatable about respective axes extending transverse to the hinge pin axis, a carrier for supporting the braking and locking members, and a spring for biasing the braking and locking members into engagement with the holding element.

2. Description of the Prior Art

The prior art discloses door locks, which are formed integrally with separable door hinges and in which the braking and locking members are formed as rolling bodies rotatable about support axles extending transverse to the hinge pin axis and engaging, under a biasing force of a loading spring supported against a free end of the hinge pin, in indentation of at least partially curved running track concentric with the hinge pin axis, with the indentations defining detent points and which is formed in an end surface of collar concentric with the hinge pin axis. The rolling bodies, which form the braking and locking members, are supported on a carrier which is formed as a metal part. The spring biasing force is applied to the carrier which is connected with the hinge pin for joint rotation therewith. In this type of door locks, a support member, to which the spring biasing force is applied and which is form-lockingly connected with the carrier of the braking and locking members by an axial toothing provided on the carrier for joint rotation with the carrier, is also formed as a metal part.

Such formation of a door lock permits to manufacture a door hinge-door lock assembly in a cost-effective manner, but is associated with certain drawbacks. Specifically, on one hand, the loading spring in these door locks is formed as a stack of plate springs and acts on a middle region of the carrier of the braking and locking members, which surrounds the hinge pin. This creates unfavorable loading conditions. On the other hand, the door locks of the above-described type, have a relatively large weight. With regard to the action of the biasing force on the middle or central region of the carrier, it should be pointed out that in case of unfavorable tolerance pairs, the door cannot be retained in a predetermined braking or locking position and/or is not retained with an adequate braking or locking force. Further, mounting of the braking and locking members, which are formed as rolling bodies, on a carrier at least partially results in a need for a relatively large mounting space for the door-hinge-door lock assembly.

Accordingly an object of the present invention is to so improve a known door lock, which is formed integrally with a door hinge for a motor vehicle door, that an exact retaining of the door in a predetermined position is insured.

Another object of the present invention is to so improve a door lock, which is formed integrally with a door hinge of a motor vehicle door, that it can be produced with minimal manufacturing costs.

A still further object of the present invention is to produce a door lock, which is formed integrally with a door hinge of a motor vehicle door, which would have reduced dimensions and weight.

A yet another object of the present invention is to produce a door lock, which is formed integrally with door hinge of a motor vehicle door, which would insure a substantially friction-free, noiseless operation of the door lock independent of tolerances.

A still further object of the invention is to produce a door lock, which is formed integrally with the door hinge of a motor vehicle door, which would insure retaining of the door in a predetermined braking or locking position with an adequate braking and locking force.

SUMMARY OF THE INVENTION

These and other objects of the present invention, which will become apparent hereinafter, are achieved by providing a door lock of the above-described type in which there are provided means which secures the holding element or the carrier to the housing without a possibility of rotation relative thereto and for axial displacement relative thereto against the spring biasing force.

The support of the door lock component, which is displaceable axially against the spring biasing force, against the housing, provides for exact guidance of the displaceable component, on one hand, and permits the use of cheaper parts for forming slide guide which would insure a backlash-free displacement of the component to a most possible extent, on the other hand. Naturally, a more reliable support and guidance of the displaceable door lock component insures an exact retaining of the motor vehicle door in a predetermined locking position. Further, the foregoing advantages are achieved independent on whether the holding element or the carrier is secured to the housing with a possibility of axial displacement relative thereto. Moreover, the possibility of securing either the holding element or the carrier to the housing permits to reduce the overall dimensions of the door lock and, thereby, to reduce the required mounting space for the door lock or the door lock-door hinge assembly. Finally, the support of the axially displaceable component against the housing permits to form the components of the locking arrangement as sheet metal stamped parts. The manufacturing costs of producing a door lock according to the present invention are substantially reduced when the axially displaceable component is secured to the housing with securing elements which includes coupling members form-lockingly engaging the housing and forming a slide guide which provides for axial displacement of the displaceable component. Advantageously, the coupling members are formed as rolling bodies engaging in support indentations formed in an inner circumference of the housing and in an outer circumference of the carrier or the holding element respectively. The rolling bodies can be formed as rollers or needles extending parallel to the hinge pin. The use of rolling bodies in particular rolling bodies which in support technology are called standard rolling bodies, insures a backlash-free and substantially friction-free support and guidance of the displaceable component, without a need in costly machining of the housing or respective components of the door lock or of the locking arrangement.

According to an advantageous embodiment of the present invention, the carrier is secured to the hinge pin for rotation there with but without a possibility of axial displacement relative thereto, and the holding element is secured to the housing and is formed as a pressure ring which is concentric with the hinge pin and is subjected to the spring biasing force. The slide guide-forming coupling members, which are formed as standard rolling bodies, connect the pressure ring to the housing without a possibility of rotation relative thereto but with a possibility of axial displacement relative thereto, with the standard rolling bodies being engageable in dome-shaped recesses formed in an outer circumferential surface of the pressure ring and being form-lockingly engageable in radial indentation formed in an inner circumferential surface of the housing. The standard rolling bodies have an axial length which exceeds a height of the pressure ring by at least a height of the detent points formed in the holding element. According to a further development of the present invention it is advantageously contemplated to form the carrier as a U-shaped cross-sectional member supported against a housing bottom by a roller bearing which is engaged by the base of the U-shaped profile with the opposite legs of the profile supporting the braking and locking members. Simultaneously the inwardly located leg of the U-shaped cross-sectional profile is provided with an inner circumferential profile, preferably, an outer circumferential toothing which form-lockingly engages the outer circumferential toothing provided on the hinge pin, whereby the carrier is connected to the hinge pin for rotation therewith.

With this embodiment, the housing can be formed as a pot-shaped member having its bottom abutting an outer surface of the one of the first and second hinge halves. The door lock further has a stud extending through the housing bottom for form-lockingly securing the housing to the one of the first and second hinge halves, and a cover against which the spring is supported, and which is form-lockingly secured to the housing. The cover is secured to the housing by mutually overlapping radially extending edge portions of the cover and the housing.

According to a further advantageous embodiment of a door lock of the present invention, with the holding element being secured to the hinge half in which the hinge pin is received with a running fit, the carrier is formed as a U-shaped cross-sectional shaped member secured to the housing, and the housing is secured to the hinge pin. In this embodiment, at least a portion of the housing circumscribing the carrier has a non-circular cross-section, with an outer circumference of the carrier having a cross-section complementary to the cross-section of the circumscribing portion of the housing.

In this embodiment, the circumscribing portion of the housing can have an octagonal cross-section. The carrier is secured to the housing with, preferably, standard rolling bodies which form a slide guide for enabling axial displacement of the carrier. The standard rolling bodies engage in dome-shaped recessed formed in an outer circumferential surface of the carrier, on one hand, and form-lockingly engage in radial indentations formed in an inner circumferential surface of the housing, the standard rolling bodies have an axial length which exceeds a height of the carrier by at least a height of the detent points formed in the holding element.

In a particular advantageous embodiment, with regard to manufacturing costs, the standard rolling bodies are supported, in an axial direction, against a wall portion of the housing, which extends transverse to the hinge pin axis at their one end and have their other end supported against a retaining member formed as a sealing profile and encompassing the housing. With this embodiment, the holding element can be formed as a sheet metal stamped part having its outer circumference formed as a collar extending parallel to the hinge pin and supported on an outer surface of the one of the first and second hinge halves, and having its inner radially-extending circumferential portion supported against the outer surface of the one of the first and second hinge halves by a roller bearing.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 2:
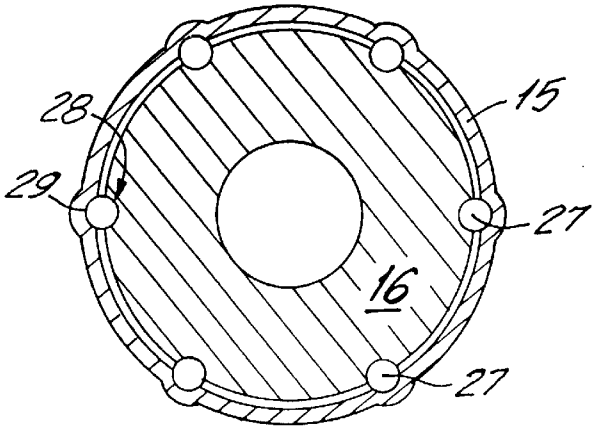
FIG. 2 shows a cross-sectional view along line 2—2 in FIG. 1.

A door hinge for a motor vehicle door, with which a door lock according to the present invention is integrally formed, includes first and second hinge halves 1 and 2, which are connected, respectively, to two parts of a door arrangement (not shown in the drawings), and a hinge pin 3 which pivotally connects the two hinge halves 1 and 2. The hinge pin 3 is supported in the first hinge half 1 for rotation relative thereto by a bearing sleeve 4 which is made from a maintenance-free bearing material and in which the hinge pin 3 is supported with a running fit. The hinge pin 3 is supported in a gudgeon 6 of the second hinge 2 for joint rotation therewith, in an assembled condition of the hinge, with radially extending, form-lockingly operating means 5. The hinge pin 3 has a shoulder 9 which is engaged between adjacent surfaces 7 and 8 of the two hinge halves 1 and 2, respectively, and has a cone projecting from the shoulder 9 toward the end of the hinge pin 3 and cooperating with the form-lockingly operating means 5. The form-lockingly operating means 5 has a corresponding, complementary conical widening formed in the gudgeon 6 of the hinge half 2.

The inventive door lock, which is formed integrally with the door hinge includes a holding element 11, which is provided with detent points 10, and a plurality of braking and locking members 12 which cooperate with the holding device 11. The door lock further includes a carrier 13 for supporting the braking and locking members 12, and a spring 14 for biasing the braking and locking members 12. The entire door lock is located in a housing 16.

Figure 3:
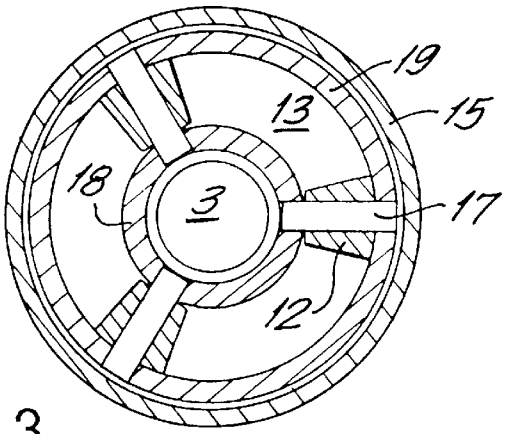
FIG. 3 shows a cross-sectional view along line 3—3 in FIG. 1.
Figure 1:
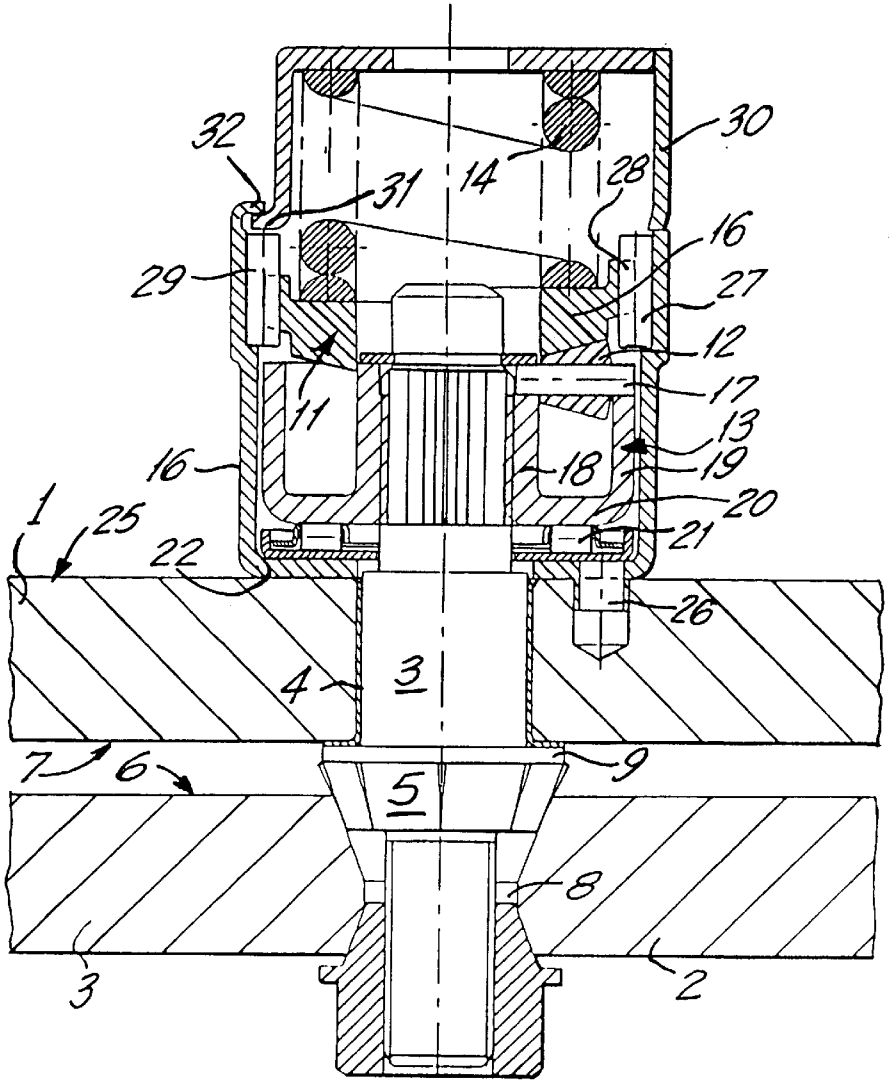
FIG. 1 shows a longitudinal cross-sectional view of a first embodiment of a door lock according to the present invention which is formed integrally with a separable door hinge for a motor vehicle.

In the embodiment of the door lock shown in FIGS. 1–3, the holding element 11 is formed as a pressure ring 16 which is surface-mounted on the braking and locking members 12 which are formed as conical rolling bodies. The holding element-forming pressure ring 16 is supported in the housing 15 with a possibility of axial displacement relative to the hinge pin 3. The braking and locking bodies 12 are rotatably supported on axles 17 which extend radially to the axis of the hinge pin 3 and are supported in opposite legs 18 and 19 of the U-shaped cross-sectional carrier 13. The carrier 13 is supported against a bottom 22 of the housing 15 by a roller bearing 21, with the base 20 of the U-shaped carrier 13 engaging the roller bearing 21. The inwardly located leg 18 of the U-shaped carrier 13 is provided with an outer circumferential toothing 23 engaging an outer circumferential toothing 23 provided on hinge pin 3. Thereby, the carrier 13 is secured to the hinge pin 3 for rotation therewith. The housing 15 lies on outer surface 25 of the hinge half 1 and is secured to the hinge half 1 with a pin 26 without a possibility of rotation relative to the hinge half 1. The holding element-forming pressure ring 16 is secured to the housing 15 without a possibility of rotation relative thereto but with a possibility of axial displacement relative thereto on a slide-in guide. The slide-in guide is formed by standard rollers 27 the axes of which extend parallel to the axis of the hinge pin 3. The rollers 27, on one hand, engage in dome-shaped recesses 28, which are formed in the outer circumferential surface of the pressure ring 16, and on the other hand, form-lockingly engage in radial indentations 29, which are formed in the inner surface of the housing 15. The rollers 27 have an axial length which exceeds the height of the pressure ring 14 at least by the height of the detent points 10 of the holding element 11. The loading spring 14, which biases the pressure ring 16 into engagement with the braking and locking members 12, is formed as a helical spring. The loading spring 14 is supported against a cover 30 of the housing 15. The cover 30 is supported against edge portions 32 of the edge of the housing 15 and is secured to the housing 15 with corresponding edge portions 31 provided on the cover 30.

Figure 4:
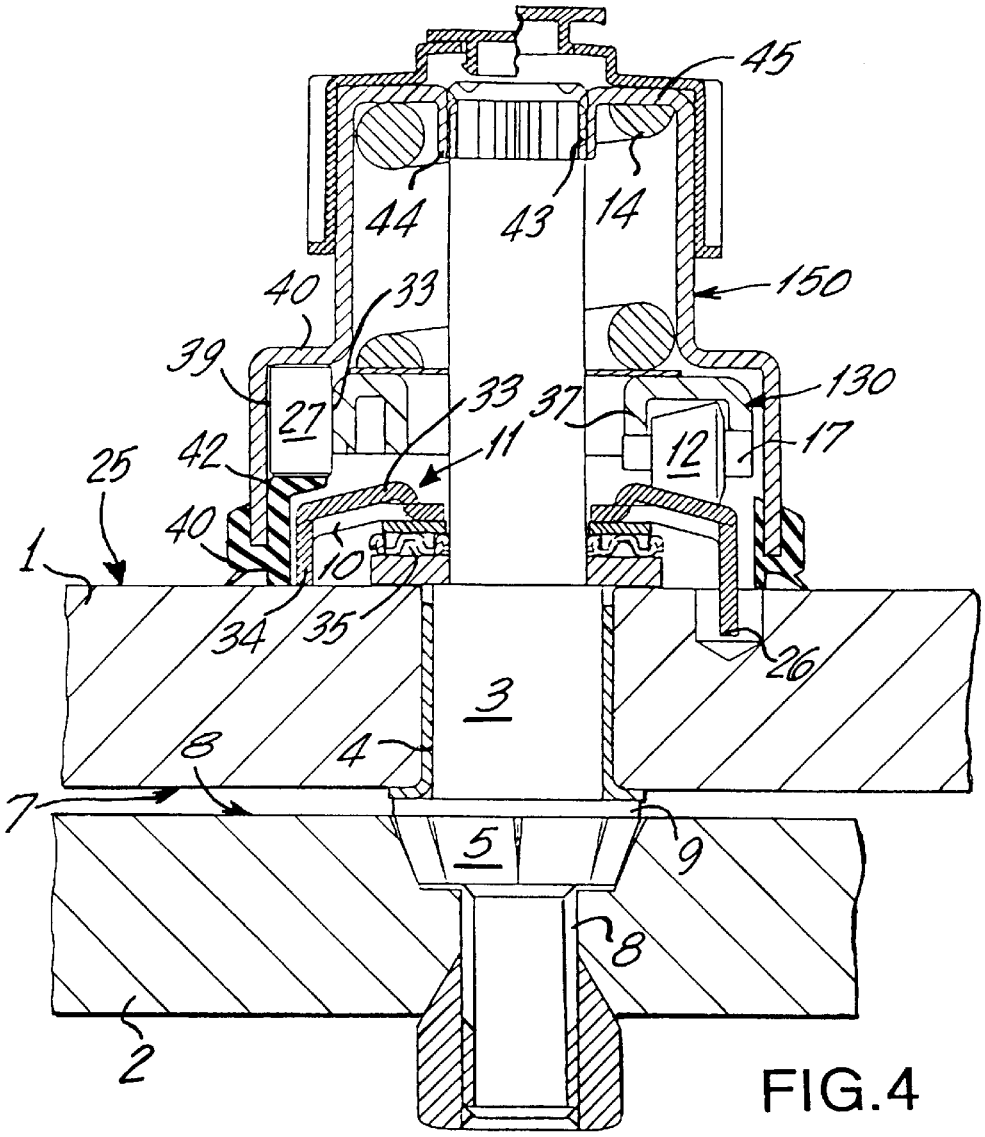
FIG. 4 shows a longitudinal cross-sectional view of a second embodiment of a door lock according to the present invention which is formed integrally with a separable door hinge for a motor vehicle.
Figure 5:
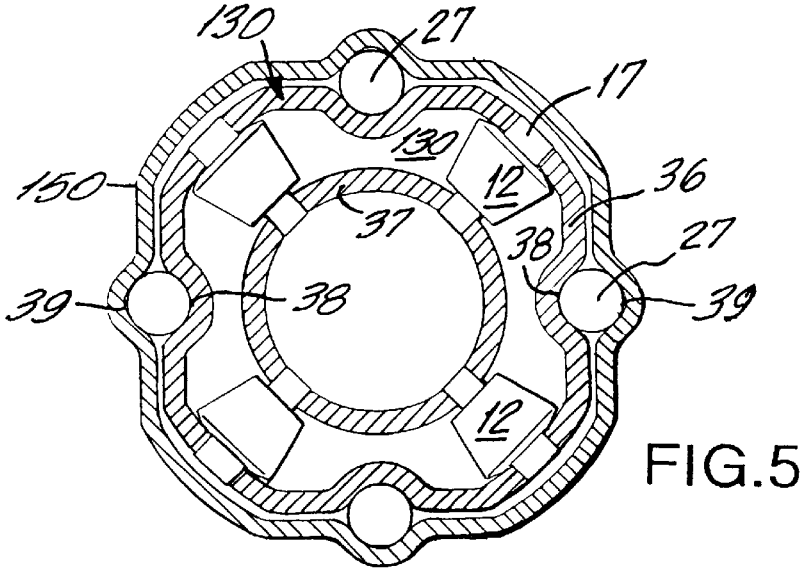
FIG. 5 shows a cross-sectional view along line 5—5 in FIG. 4.

In the embodiment of a door lock according to the present invention, which is shown in FIGS. 4–5, the holding element 11, which is provided with the detent points 10, is formed as a sheet metal stamped part 33 supported against the outer surface 25 of the first hinge half 1 by a collar 34 which extends parallel to the axis of the hinge pin 3. The inwardly located circumferential portion of the holding element 13 is supported against the outer surface 35 of the first hinge half 1 by an intermediate roller bearing ring 35. The holding element 11 is secured to the first hinge half 1 by a pin extension 26 of the collar 34. The carrier 130 of the braking and locking members 12 is likewise formed as a U-shaped cross-sectional member, with the axles 17 of the braking and locking members 12 being supported in opposite legs 36, 37 of the U-shaped cross-section of the carrier 150. The carrier 150 is formed as a shaped part. The carrier 150 is axially biased by the loading spring 14 which is formed as a compression spring and is capable of displacement against the biasing force of the spring 14. The carrier 130 is secured in a housing 150 for joint rotation therewith which, in turn, is secured to the hinge pin 3 for rotation therewith. The housing 150 has, in its region, which surrounds the carrier 130, a non-circular shape. In the embodiment shown in FIGS. 4–5, the carrier-surrounding region of the housing 150 has an octagonal cross-sectional profile inscribed in a square. The leg 36, which forms an outer wall of the carrier 130 has a cross-section which, in plan view, complements the cross-section of the housing 150, with the supporting axles 17 being directed toward corners of an imaginary square. The carrier 130 is supported in the housing 150 for joined rotation therewith and for axial displacement relative thereto by slide-in guide similar to that of the embodiment of the door lock shown in FIGS. 1–3. The slide-in guide is formed, as in the embodiment of FIGS. 1–3, by standard rollers 27 the axes of which extend parallel to the axis of the hinge pin 3. The roller 27, on one hand, engage in dome-shaped recesses 38 which are formed in the outer circumferential surface of the carrier 130 and, on the other hand, form-lockingly engage in indentations 39 which are formed in the inner surface of the housing 150. The rollers 27 have an axial length which exceeds the height of the carrier 130 at least by the height of the detent point 10 of the holding element 11. The slide-in guide-forming rollers 27 are supported, with respect to the hinge pin axis, against a wall section 40 of the housing 150, which extends transverse to the hinge pin axis, on one hand, and is supported, on the other hand, against a retaining member 42 which is formed as a sealing profile 41 and which encompasses the portion of the wall of the housing 150 adjacent to the first hinge half 1. The housing 150 has a collar 44 provided with an inner circumferential toothing 43 which cooperates with an outer toothing provided at the free end of the hinge pin 3 for securing the housing 150 to the hinge pin 3 for rotation therewith. The loading spring 14, which is formed as a helical spring, is supported against the bottom 45 of the housing 150.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door lock formed integrally with a motor vehicle door hinge having a first half connectable with one part of a door assembly, a door or a door pillar, a second hinge half connectable with another part of the door assembly, and a hinge pin for connecting the first and second hinge halves for a rotational movement relative to each other and supported in one of the first and second hinge halves with a running fit and fixedly secured in another of the first and second hinge halves for joint rotation with another of the first and second hinge halves, the door lock comprising:

a housing fixedly secured to one of the hinge pin and the one of the first and second hinge halves without a possibility of rotation relative to the one of the hinge pin and the one of the first and second hinge halves;

a holding element having at least a partially curved running track concentric with a hinge pin axis and a plurality of detent points;

a plurality of braking and locking members cooperating with the holding element for retaining a motor vehicle door in a predetermined braking and locking position, and formed as rolling bodies rotatable about respective support axles having axes thereof extending transverse to a hinge pin axis;

a carrier for supporting the braking and locking members;

spring means for biasing the braking and locking members into engagement with the holding element; and means for securing one of the holding element and the carrier to the housing without a possibility of rotations relative thereto and for axial displacement relative thereto against a biasing force of the spring means and for securing another one of the holding element and the carrier to another one of the hinge pin and the one of the first and second hinge halves.

2. A door lock as set forth in claim 1, wherein the securing means comprises coupling members form-locking engaging the housing and forming a slide guide for enabling the axial displacement of the one of the carrier and the holding element.

3. A door lock as set forth in claim 2, wherein the coupling members are formed as rolling bodies engaging in support indentations formed in an inner circumference of the housing and in an outer circumference of the one of the carrier and the holding element, respectively.

4. A door lock as set forth in claim 3, wherein the rolling bodies are formed as one of rollers and needles extending parallel to the hinge pin.

5. A door lock as set forth in claim 2, wherein the carrier is secured to the hinge pin for rotation therewith but without possibility of an axial displacement relative thereto, and the holding element is secured to the housing and is formed as a pressure ring.

6. A door lock as set forth in claim 5, wherein the coupling members are formed as a standard rolling bodies engageable in dome-shaped recesses formed in an outer circumferential surface of the housing, and wherein the standard rolling bodies have an axial length which exceeds an axial length of the holding element-forming pressure ring by at least an axial dimension of the detent points formed in the holding element.

7. A door lock as set forth in claim 1, wherein the carrier is formed as a U-shaped cross-sectional member supported against a housing bottom by a roller bearing which is engaged by a base of the U-shaped profile of the carrier, with the opposite legs of the U-shaped profile supporting the braking and locking members.

8. A door lock as set forth in claim 1, wherein the housing is formed as a pot-shaped member having a bottom thereof abutting an outer surface of the one of the first and second hinge halves, and wherein the door lock further comprises means extending through the housing bottom for form-lockingly securing the housing to the one of the first and second hinge halves, a cover against which the spring means is supported, and means for form-lockingly securing the cover with the housing.

9. A door lock as set forth in claim 8, wherein the means for form-lockingly securing the cover with the housing comprises mutually overlapping radially extending edge portions of the cover and the housing.

10. A door lock as set forth in claim 1, wherein the carrier is formed as a U-shaped cross-sectional member an inwardly located leg of a U-shaped cross-sectional profile of which has an outer circumferential toothing form-lockingly engageable with an outer circumferential toothing provided on the hinge pin for connecting the carrier with the hinge pin for rotation therewith.

11. A door lock as set forth in claim 1, wherein the holding element is secured to the one of the first and second hinge halves, wherein the carrier is formed as a U-shaped cross-sectional shaped member secured to the housing, and the housing is secured to the hinge pin.

12. A door lock as set forth in claim 11, wherein the carrier is secured to the housing, and wherein at least a portion of the housing circumscribing the carrier has a non-circular cross-section, and an outer circumference of the carrier has a cross-section complementary to the cross-section of the at least circumscribing portion of the housing.

13. A door lock as set forth in claim 12, wherein the at least circumscribing portion of the housing has an octagonal cross-section maximal mutually perpendicular dimensions of which are equal to each other.

14. A door lock as set forth in claim 11, wherein the securing means comprises standard rolling bodies forming a slide guide for enabling axial displacement of the carrier, wherein the standard rolling bodies engage in dome-shaped recesses formed in an outer circumferential surface of the carrier, on one hand, and form-lockingly engage in radial indentations formed in an inner circumferential surface of the housing, and wherein the standard rolling bodies have an axial length which exceeds an axial length of the carrier by at least an axial dimension of the detent points formed in the holding element.

15. A door lock as set forth in claim 11, wherein the housing has a neck-shaped collar defining a portion of a housing bottom against which the spring means is supported, wherein the collar is provided with an inner circumferential profile form-lockingly engageable with a corresponding outer circumferential profile formed on a free end of the hinge pin for securing the housing with the hinge pin.

16. A door lock as set forth in claim 15, wherein the inner circumferential profile is formed as toothing.

17. A door lock as set forth in claim 11, wherein the holding element is formed as a sheet metal stamped part having its outer circumference formed as a collar extending parallel to the hinge pin and supported on an outer surface of the one of the first and second hinge halves, and having its inner radially extending circumferential portion supported against the outer surface of the one of the first and second hinge halves by a roller bearing.

18. A door lock formed integrally with a motor vehicle door hinge having a first half connectable with one part of a door assembly, a door or a door pillar, a second hinge half connectable with another part door assembly, and a hinge pin for connecting the first and second hinge halves for a rotational movement relative to each other and supported in one of the first and second hinge halves with a running fit and fixedly secured in another of the first and second hinge halves for joint rotation with another of the first and second hinge halves, the door lock comprising:

a housing fixedly secured to one of the hinge pin and the one of the first and second hinge halves without a possibility of rotation relative to the one of the hinge pin and the one of the first and second hinge halves;

a holding element having at least a partially curved running track concentric with a hinge pin axis and a plurality of detent points;

a plurality of braking and locking members cooperating with the holding element for retaining a motor vehicle door in a predetermined braking and locking position, and formed as rolling bodies rotatable about respective support axles having axes thereof extending transverse to a hinge pin axis;

a carrier for supporting the braking and locking members;

spring means for biasing the braking and locking members into engagement with the holding element; and means for securing one of the holding element and the carrier to the housing without a possibility of rotations relative thereto and for axial displacement relative thereto against a biasing force of the spring means and for securing another one of the holding element and the carrier to another one of the hinge pin and the one of the first and second hinge halves, wherein the holding element is secured to the one of the first and second hinge halves, wherein the carrier is formed as a U-shaped cross-sectional shaped member secured to the housing, and the housing is secured to the hinge pin, wherein the securing means comprises a standard rolling bodies forming a slide guide for enabling axial displacement of the carrier, wherein the standard rolling bodies engage in dome-shaped recesses formed in an outer circumferential surface of the carrier, on one hand, and form-lockingly engage in radial indentations formed in an inner circumferential surface of the housing, wherein the standard rolling bodies having an axial length which exceeds a height of the carrier by at least a height of the carrier by at least a height of the detent points formed in the holding element, wherein the standard rolling bodies are supported, in an axial direction, against a housing wall portion which extends transverse to the hinge pin axis, and a retaining member formed as a sealing profile and encompassing the housing.

* * * * *